US005524552A

United States Patent [19]

Weber

[11] Patent Number: 5,524,552

[45] Date of Patent: Jun. 11, 1996

[54] SINGLE AXLE TRUCK FOR LARGE RAILROAD CARS

[75] Inventor: Hans B. Weber, Rotonda West, Fla.

[73] Assignee: National Castings Incorporated, Downers Grove, Ill.

[21] Appl. No.: 271,980

[22] Filed: Jul. 8, 1994

[51] Int. Cl.[6] ..... B61F 5/00

[52] U.S. Cl. ..... 105/199.5; 105/176; 213/15

[58] Field of Search ..... 105/168, 176, 105/199.3, 199.5; 213/15, 75 R

[56] References Cited

U.S. PATENT DOCUMENTS

| | | | |
|---|---|---|---|
| 900,025 | 9/1908 | Krakau | 213/15 |
| 1,000,292 | 8/1911 | Pope | 213/15 |
| 2,190,539 | 2/1940 | Cameron | 213/15 X |
| 2,846,954 | 8/1958 | Gaynor | 105/168 X |
| 3,350,146 | 10/1967 | Williams | 105/200 X |
| 3,961,582 | 6/1976 | Paton et al. | 105/176 X |
| 4,590,864 | 5/1986 | Przybylinski | 105/199.5 |

*Primary Examiner*—Robert J. Oberleitner
*Assistant Examiner*—Kevin D. Rutherford

[57] ABSTRACT

A specially designed single axle truck is designed for use on extra long railroad cars which are sixty feet or longer to accommodated bigger and heavier loads. The single axle trucks are secured to rigid subframes which, in turn, are mounted on the under carriage of a railroad freight car, adjacent each of the opposing ends of the car, for rotation in a horizontal plane, when the car is resting on a horizontal trackway. The rigid subframes are each provided with a pair of outstanding arms which are designed to engage the car coupler means. whether it be a single drawbar, fixed jaw coupler, or a knuckle type coupler such as an AAR standard F coupler, to engage and transfer lateral movement of the car coupler means into rotary movement of the rigid subframes to actively steer the attached single axle trucks safely through curves in the trackway which the single axle truck would be unable to negotiate, if it were rigidly secured to the under carriage of the railroad car. Means are provided between the rigid subframes and under carriage of the railroad car for stabilizing the car in supported relation on the rigid subframes and attached single axle trucks.

20 Claims, 4 Drawing Sheets

SINGLE AXLE TRUCK FOR LARGE RAILROAD CARS

BACKGROUND OF THE INVENTION

The invention relates to railroad car trucks or boogies, especially single axle trucks which are manufactured by National Castings Incorporated of Chicago, Ill. under the trademark UNITRUCK. These single axle trucks are mainly used on trailer carrying flat cars (TOFC) and container carrying flat cars (COFC), or on the end cars of articulated bulk load carrying railroad cars, and are rigidly secured to the structural steel framework of the bottom or under carriage of each one of the cars, closest the trackway along which the cars move. Unlike the more commonly used dual axle truck, this single axle truck has for all practical purposes, no steering capability, since its so-called passive steering is limited to about one and one-half degrees measured from either side of a horizontal axis which is normal to the longitudinal axis of a railroad car, when the car is resting on a horizontal trackway.

Current freight cars, up to about fifty feet long with truck centers of about thirty-six feet and equipped with single axle trucks of such limited passive steering, can negotiate the curves of existing trackways in the United States without derailing. However, freight cars are ever increasing, in size, some to about ninety feet, in length, to accommodate larger and heavier loads which railway companies are being asked to transport. To use existing, rigidly connected single axle trucks on such extra long freight cars would be prohibitive and cause derailment of the freight cars, since these trucks do not have the steering capability to negotiate such curves.

Thus, railroad car builders and the railway companies are faced with two alternate choices. The first choice is to use a dual axle truck at each end of these extra long freight cars, instead of the single axle truck, but this literally doubles the number of wheels, axles and associated parts required in the make up of a train of freight cars. The second choice is to use a single, dual axle truck between adjacent, extra long freight cars, but this presents a problem when freight cars are uncoupled from one another, since at least one end of an uncoupled freight car becomes unsupported for a period of time. The invention is designed to overcome such problems.

Briefly stated, the invention is in a device which is used at either end of a railroad car for supporting the car as it moves along a trackway. The device includes a single axle truck which is firmly secured to a rigid, structural steel subframe which, in turn, is rotatably mounted to the structural steel framework of the under carriage of the freight car at each end of the car. Each one of the rotatable, rigid subframes is provided with one or a pair of steering arms which are designed to engage either a single drawbar or an interlocking, rigid jaw or knuckle type coupler, both of which are used to couple adjacent freight cars together.

The steering arms are responsive to movement of the car coupling mechanism as the regular or extra long freight cars move along a curved trackway, and act to correspondingly rotate the rigid subframes to actively steer the single axle trucks along the curved trackway. Moreover, the single axle trucks of adjacent, extra long freight cars are only about ten to fourteen feet apart, as compared to about forty-six to fifty feet apart when such trucks are used adjacent each of the opposing ends of, for example, a sixty foot long railroad car, to provide further assurance that no derailments will occur, since the center distance between the trucks of adjacent railroad cars is important and effects or determines the steering characteristics of the trucks.

DESCRIPTION OF THE DRAWING

The following description of the invention will be better understood by having reference to the accompanying, wherein:

FIG. 8 is similar to FIG. 4, but of the second embodiment.

DETAILED DESCRIPTION OF THE DRAWING

Figure 1:
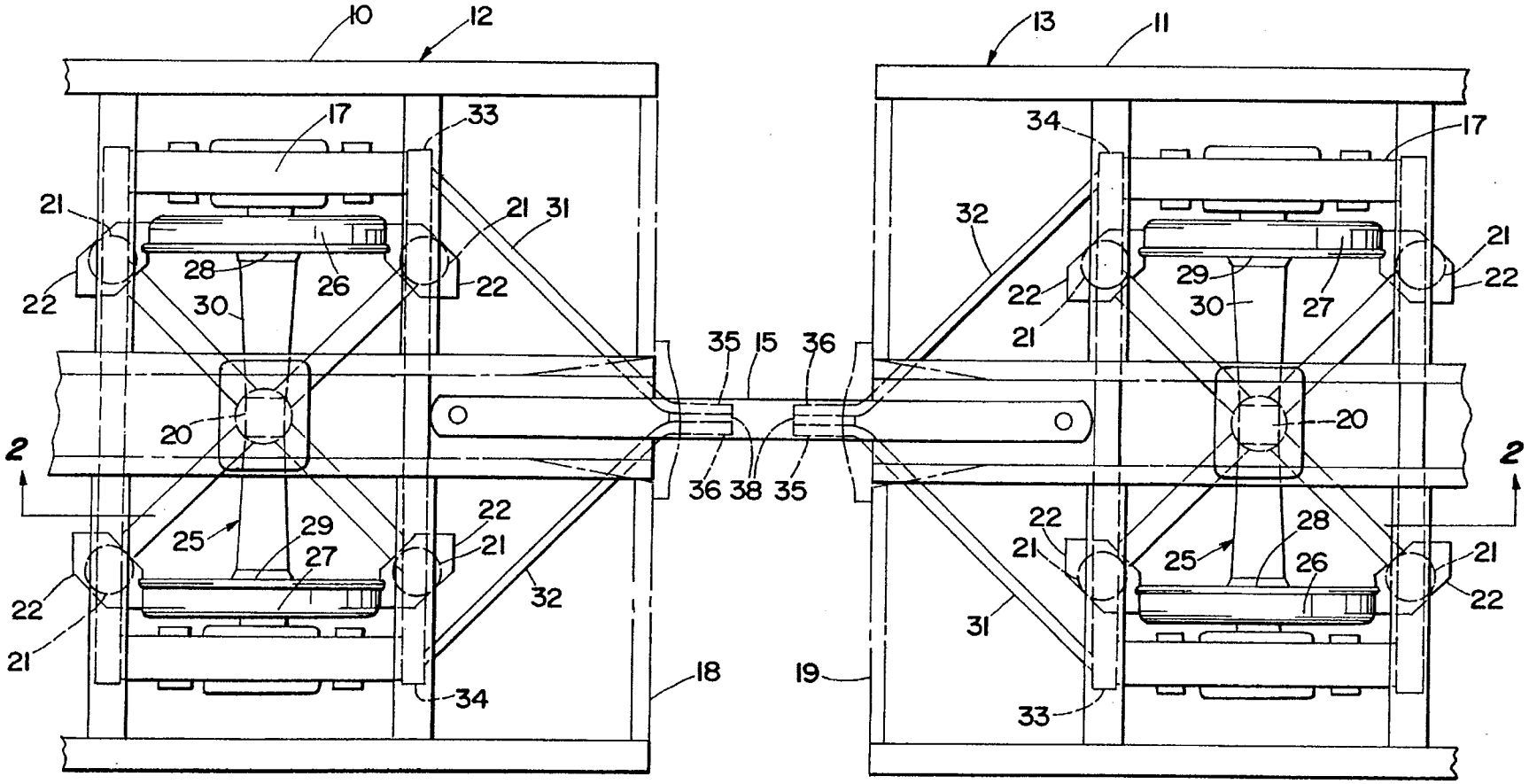
FIG. 1 is a plan view of a portion of adjacent railroad cars which are mounted on single axle trucks which are made in accordance with the invention, the adjacent railroad cars being coupled together by a single drawbar.
Figure 2:
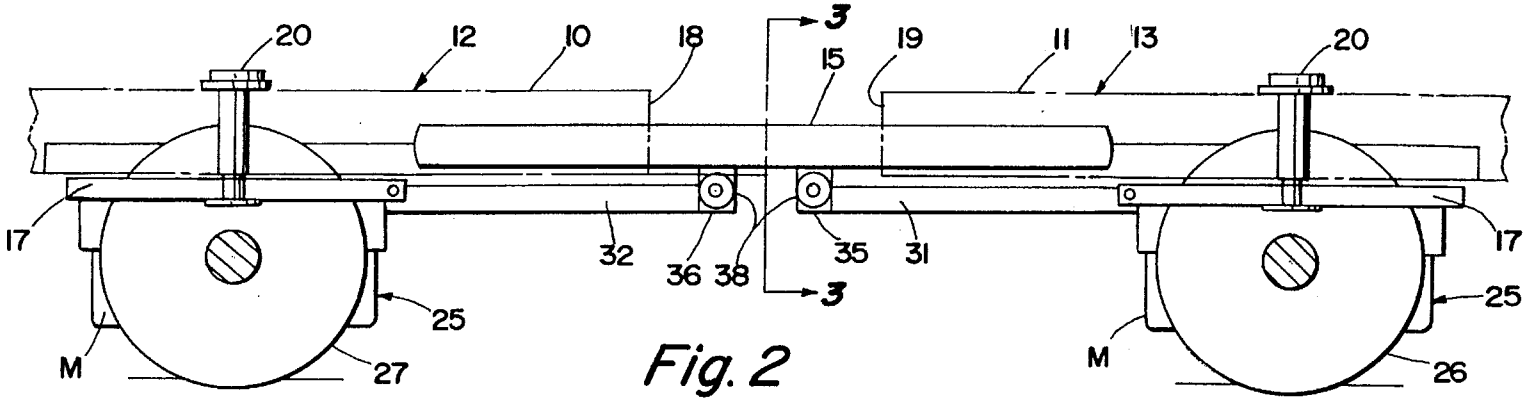
FIG. 2 is a section of the railroad cars and trucks viewed from the line 2—2 of FIG. 1.
Figure 4:
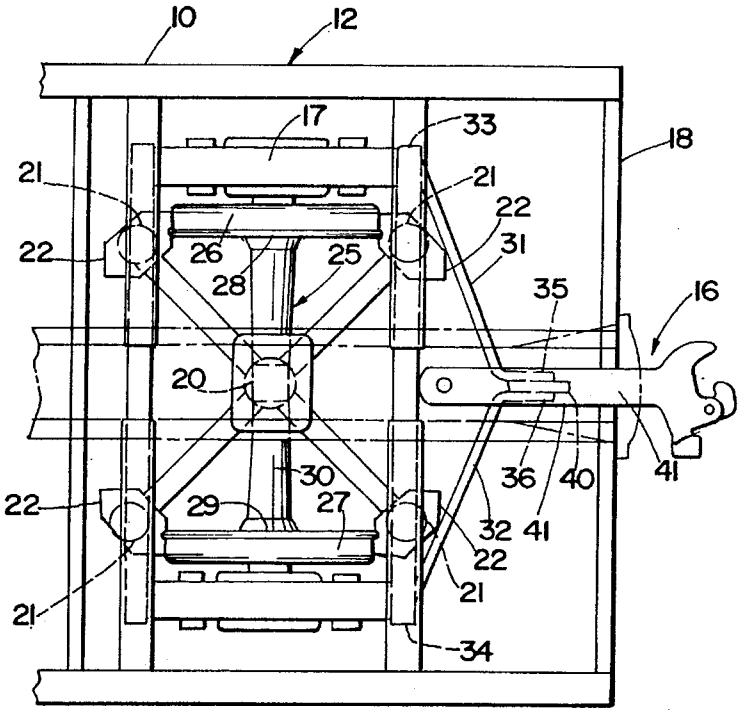
FIG. 4 is a plan view of one of the railroad cars and trucks, designed to show the use of, for example, an AAR standard type F coupler, in place of the drawbar.
Figure 3:
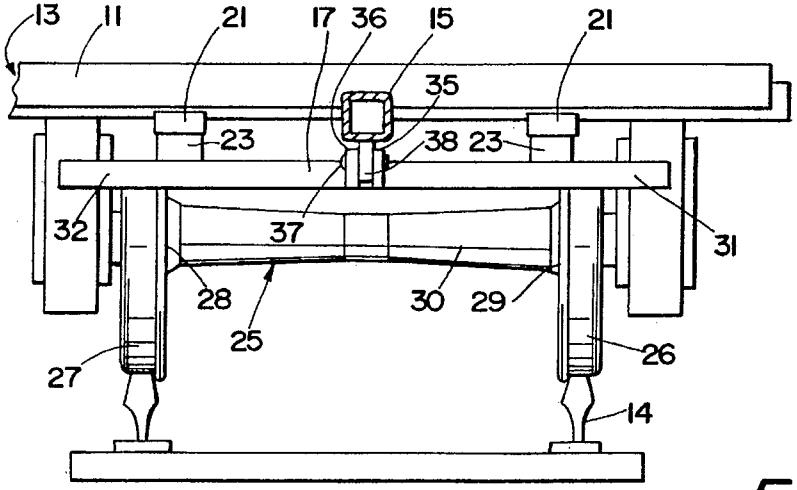
FIG. 3 is a front view of one of the railroad cars and trucks as seen, for example, from the line 3—3 of FIG. 2.

With general reference to the drawing for like parts, and particular reference to FIGS. 1–4, there is shown portions of two structural steel under carriages 10 and 11 of a pair of adjacently disposed railroad freight cars 12 and 13, respectively, which, for the purpose of explanation, are assumed to be resting on a horizontal trackway 14, as best seen in FIG. 3. A single drawbar 15 is used to couple the adjacent freight cars 12 and 13 together, but can be replaced, for example, by a pair of similar, interlocked AAR standard type F couplers 16, as seen in FIG. 4.

A rigid, cross-braced, rectangular structural steel subframe 17 is pivotally mounted adjacent the opposing ends of each freight car or, as seen in FIG. 1, adjacent the confronting ends 18 and 19 of the coupled freight cars 12 and 13. The rigid subframes 17 are mounted for rotation in the same horizontal plane by any suitable pivot mount 20 which is disposed between each one of the rigid steel subframes 17 and the under carriages 10 and 11 of the freight cars 12 and 13. The rigid subframes 17 rotate below the undercarriages 10 and 11 of the freight cars 12 and 13.

Each one of the rigid subframes 17 is provided with four, similar, low friction, load bearing pads 21 which are rectangularly spaced on the rigid subframe 17 and designed to slidably contact adjacent metal plates 22 which are diagonally secured to the underside of the under carriages 10 and 11 of the freight cars 12 and 13, closer the trackway 14, to stabilize the freight cars 12 and 13 in supported relation on the substantially smaller, rigid subframes 17 without impeding limited rotation of the rigid subframes 17 relative to an attached railroad car. Each one of the low friction bearing pads 21 can be atop a pedestal 23, as seen in FIG. 3, or fastened directly to the adjacent under carriage 12 or 13, depending on the particular steel structure of the under carriage.

A single axle truck 25 of UNITRUCK design, as more thoroughly explained in U.S. Pat. No. 3,394,662 which, by reference, is made a part of this application, is securely fastened to each one of the rigid subframes 17 for rotating, in unison, with the attached rigid subframe. Briefly, a UNITRUCK single axle truck essentially comprises a pair of AAR standard railroad car wheels 26 and 27 (FIG. 3) which are secured at opposing ends cushioning loads imparted to the single axle 30.

A pair of steering arms 31 and 32, as best seen in FIGS. 1 and 2, are provided on each one of the rigid, truck subframes 17 for actively steering the single axle trucks 25 along a curved trackway by rotating the truck subframes 17 as the coupled freight cars travel along the curved trackway. Actually, the steering arms 31 and 32 of each truck subframe 17 are designed to engage the coupling mechanism between adjacent freight cars and respond to any lateral movement of the coupling mechanism caused by lateral curvature of the trackway, to correspondingly rotate the attached truck subframes 17, whereby the attached single axle trucks are actively steered along curves in the trackway.

Each pair of steering arms 31 and 32 is secured to a truck subframe 17 at opposing laterally aligned sides 33 and 34 of the truck subframes 17, and converge therefrom in a direction towards an adjacent coupled freight car where they terminate at a pair of laterally spaced, outstanding ends 35 and 36 which, in the embodiment of FIGS. 1–3, are designed to be secured by pins or bolts 37 to downwardly extending, rectangular brackets 38 which are carried by the drawbar 15 between the middle of the drawbar 15 and adjacent confronting ends 18 and 19 of the coupled railroad cars 12 and 13. When the coupling mechanism is a standard type coupler 16, the outstanding ends 35 and 36 of the steering arms 31 and 32 are secured to a similarly shaped, downwardly extending, rectangular bracket 40 which is secured to the adjacent shank 41 of the coupler 16.

Figure 5:
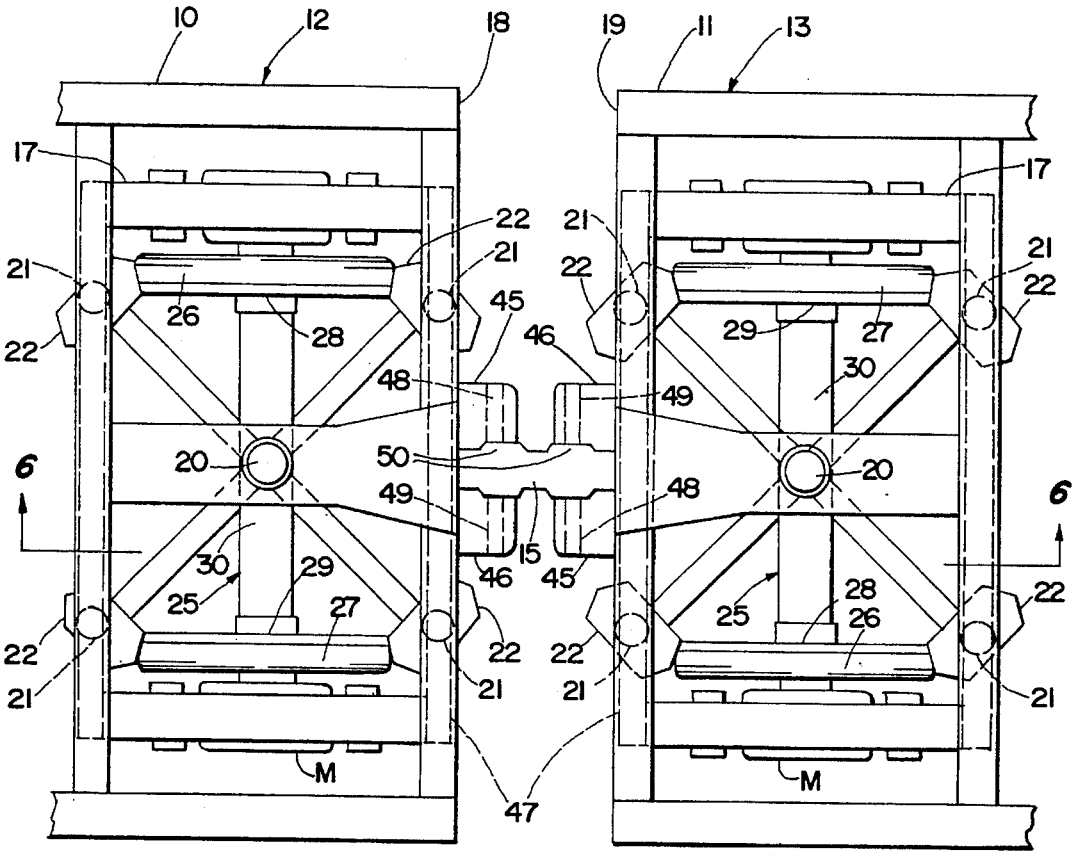
FIG. 5 is a plan view, similar to FIG. 1, but of a second embodiment of the invention.
Figure 8:
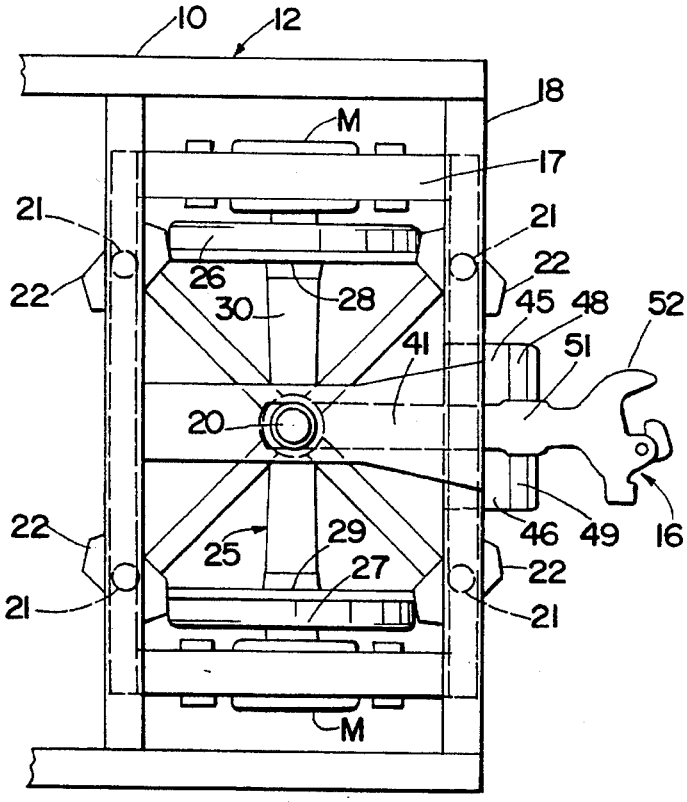
FIG. 8 is similar to FIG. 4, but of the second embodiment with an F coupler.

It should be readily apparent that the embodiment of the invention seen in FIGS. 5–8, is essentially the same as that previously disclosed, except for the steering arms which, in this case, comprise a single rectangular plate or pair of parallel, rectangular plates or arms 45 and 46, depending on the vertical angling required of the drawbar 15 or coupler 16. The steering arms 45 and 46 are centrally secured on, and extend from, the side 47 of each of the truck subframes 17 confronting an adjacent freight car, e.g. car 13 when the arms 45 and 46 extend from the freight car 12. The pair of steering arms 45 and 46 are provided with a pair of laterally spaced, similar, but oppositely disposed, upstanding, confronting triangular shaped brackets 48 and 49 which, as best seen in FIGS. 5 and 8, are designed to straddle enlarged, reinforced shank areas 50 and 51 of the drawbar 15 and coupler 16, respectively. The enlarged shank areas 50 and 51 are adjacent the middle of the drawbar 15 and coupler head 52, respectively. The use of a single plate is tantamount to the use of a single steering arm with a bifurcated end for straddling the shanks of the drawbar or coupler.

In the second embodiment of FIGS. 5–8, the drawbar 15 and coupler 16 are pinned to a pivot pin 53 which is used in the pivotal connection 20 between the rigid truck subframes 17 and the under carriages 10 and 11 of the railroad cars 12 and 13. Such an arrangement is precluded when the longer, angularly disposed steering arms 31 and 32 of FIGS. 1–4 are used in combination with a standard size drawbar 15 or coupler 16 which are pinned to the railroad cars 12 and 13 between the pivotal connections 20 and the confronting ends 18 and 19 of the railroad cars 12 and 13, respectively.

Figure 6:
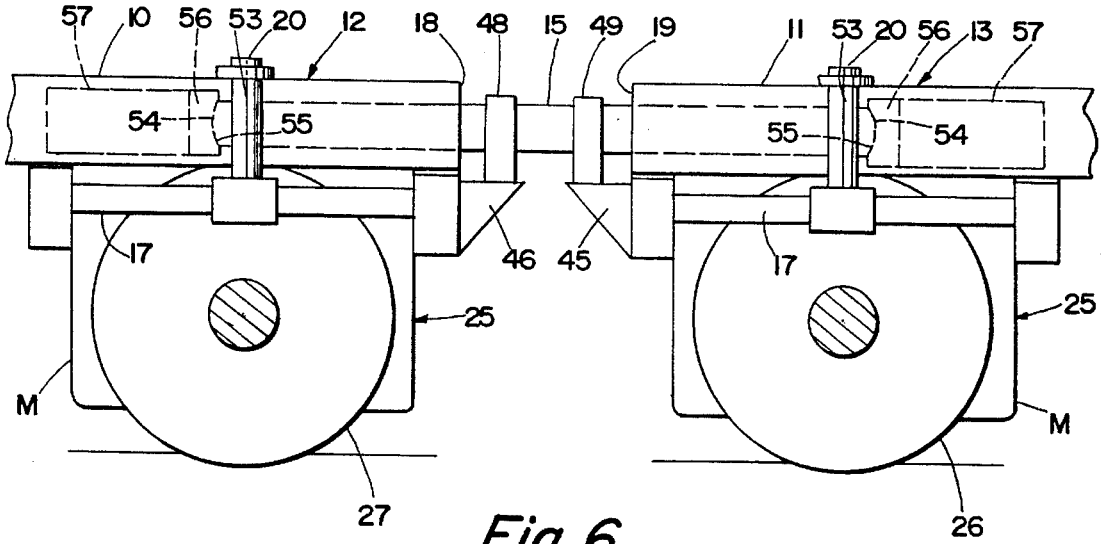
FIG. 6 is a section viewed from the line 6—6 of FIG. 5.
Figure 7:
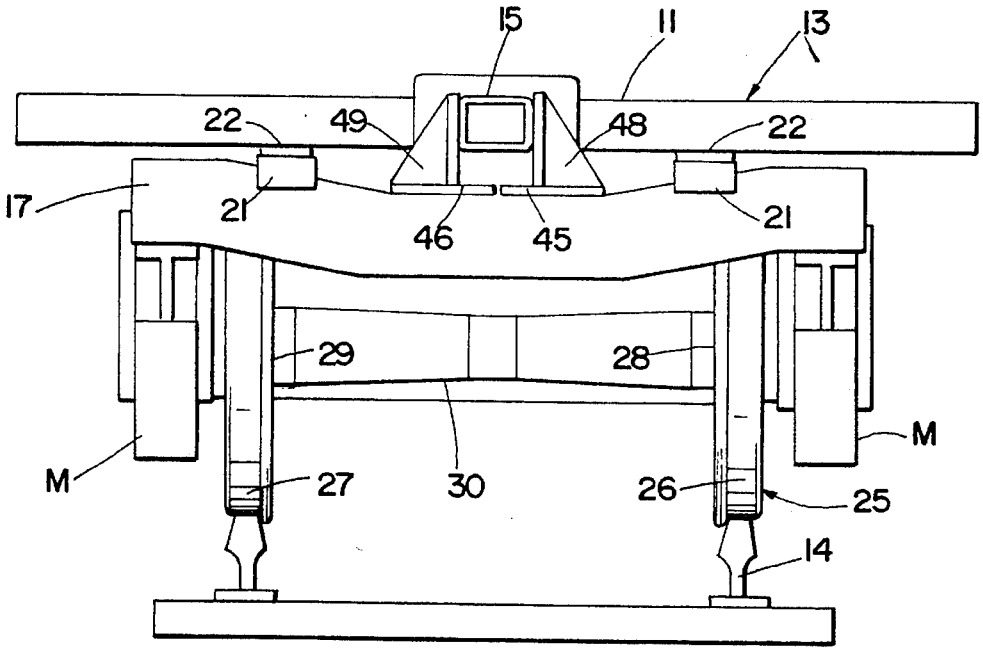
FIG. 7 is similar to FIG. 3, but of the second embodiment.

In either embodiment, the parti-spherical butt ends 54 of the drawbars 15 or couplers 16, as best seen in FIG. 6, can be seated in a matingly shaped cavity 55 which is formed in a front follower 56 that coacts with a device 57 which includes, I) resilient pads for cushioning impact loads, or II) adjusting wedges for taking up slack in the coupling arrangement.

Thus, there has been described a unique freight car truck structure which has the capability of using single axle trucks on either normal size freight cars or extra long freight cars. The single axle trucks are each secured to a rigid, rectangular platform or subframe which is actively steered or rotated in corresponding relation to lateral movement of the coupling mechanism between adjacent freight cars, as the cars move along curves of the trackway. The use of this single axle truck at each end of a freight car guarantees support for the car during the uncoupling process. Also, the initial cost of using single axle trucks rather than dual axle trucks, is much less, and the repairs are more economical, since fewer parts are involved.

What is claimed is:

1. A device for supporting each of the opposing ends of a railroad car as the car moves along a trackway, comprising:

a) a rigid subframe adapted for rotating in a horizontal plane adjacent at least one of the opposing ends of a railroad car, when the car is resting on a horizontal trackway;

b) a single axle truck secured to the rigid subframe for rotating, in unison, with the rigid subframe, the truck including a single axle and a pair of wheels which are rotatable with the single axle at opposing ends of the single axle; and c) means carried by the rigid subframe and adapted for engagement with means for connecting adjacent railroad cars together, in tandem, the means being free of any resilient springs so as to be non-resilient and responsive to lateral movement of the car connecting means as attached railroad cars move along a curve in the trackway, for correspondingly rotating the rigid subframe and attached truck to positively, actively steer the single axle truck through the curve in the trackway.

2. The device of claim 1, wherein the means for actively steering the single axle truck, includes:

d) at least one arm secured to, and extending from, the rigid subframe and terminating at a free end which is in spaced relation from the subframe, the free end of the arm adapted for engagement with the car connecting means intermediate opposing ends of the car connecting means.

3. The device of claim 2 which includes means carried by the rigid subframe for stabilizing the railroad car in supported relation on the rigid subframe.

4. The device of claim 3, wherein the free end of the at least one arm carries a pair of fixed, upstanding, confronting brackets adapted for straddling the car connecting means.

5. The device of claim 4, wherein a pair of adjacent railroad cars are connected, in tandem, by connecting means selected from the group of drawbars and interlocking knuckle-type couplers.

6. The device of claim 3 wherein the means for actively steering the single axle truck includes a pair of arms secured to the rigid subframe at laterally spaced and aligned points on opposing sides of the rigid subframe, the pair of arms converging towards each other in a direction away from the attached rigid subframe and terminating at a pair of outstanding free ends which are in laterally spaced relation and adapted for fastening to the car connecting means.

7. The device of claim 6, wherein a pair of adjacent railroad cars are connected, by a single drawbar which has a pair of brackets which are oppositely spaced from the middle of the drawbar and which extend downwardly from the drawbar in a direction towards a pair of adjacent rigid subframes, the brackets adapted for pivotal connection with adjacent, outstanding free ends of the pairs of arms of the adjacent pair of rigid subframes.

8. The device of claim 3, wherein the car stabilizing means includes at least one pair of low friction bearing pads disposed on opposing sides of the rigid subframe for relative sliding engagement with the railroad car.

9. The device of claim 1, which includes a cushioning mechanism carried by the single axle truck adjacent each wheel thereof, for absorbing vibrations caused by impact loads imparted to the wheels of the truck during operation thereof.

10. A railroad freight car which, when horizontally disposed, comprises:

a) a rigid, under carriage supporting the framework of the car which has a pair of opposing ends;

b) a pair of rigid subframes adjacent the opposing ends of the car;

c) means mounting the rigid subframes below the under carriage for rotating in horizontal planes;

d) a number of low friction bearing pads carried by each of the rigid subframes in close proximity to the undercarriage for sliding engagement with adjacent flat surfaces of the under carriage of the car to stabilize the car in supported relation on the rigid subframes;

e) a single axle truck secured to each of the rigid subframes for rotation therewith, the single axle trucks extending from the rigid subframes and having wheels for rolling engagement with rails of a trackway disposed below the car;

f) car coupling means designed to couple each of the opposing ends of the car to adjacent railroad cars; and g) means carried by each of the rigid subframes for engaging an adjacent car coupling means, said car coupling engaging means being free of any resilient springs so as to be non-resilient and responsive to at least lateral movement of the car coupling means as the car moves along a curve in the trackway, to correspondingly rotate the rigid subframes to positively, actively steer the attached single axle trucks through the curve.

11. The railroad car of claim 10, wherein the means for rotating the rigid subframes includes:

h) a car coupling means with an elongated shank; and i) at least one steering arm secured to each of the rigid subframes and extending therefrom in a direction towards an adjacent elongated shank for engagement therewith and responsive to movement thereof, whereby the attached rigid subframe is rotated to actively steer the attached single axle truck.

12. The railroad car of claim 11, wherein the at least one steering arm includes a pair of steering arms which converge in a direction away from the attached rigid subframe for engaging a bracket which is secured to the elongated shank.

13. The railroad car of claim 10, wherein the car coupling means is selected from the group of drawbars, fixed jaw couplers, and knuckle type couplers.

14. The device of claim 10, which includes a cushioning mechanism carried by the single axle truck adjacent each wheel thereof, for absorbing vibrations caused by impact loads imparted to the wheels of the truck during operation thereof.

15. A device for supporting each of the opposing ends of a railroad car having a rigid undercarriage, as the car moves along a trackway, comprising:

a) a rigid subframe adapted for rotating in a horizontal plane adjacent each of the opposing ends of a railroad car, when the car is resting on a horizontal trackway;

b) a single axle truck secured to each of the rigid subframes for rotating, in unison, with the rigid subframes, each of the trucks including a single axle and a pair of wheels which are rotatable with the single axle at opposing ends of the single axle; and c) means carried by each of the rigid subframes and responsive to movement of the railroad car along a curve in the trackway, for correspondingly rotating the rigid subframes to actively steer the single axle trucks through the curve in the trackway, the means for actively steering each of the single axle trucks including, at least one steering arm secured to each rigid subframe and centrally disposed thereon and extending therefrom and terminating in spaced relation from the subframe at a pair of upstanding, confronting brackets which are adapted for straddling engagement with means for connecting a pair of railroad cars, in tandem, for movement along a trackway, such that lateral movement of the connecting means causes corresponding rotary movement of the rigid subframe to actively steer the attached single axle truck.

16. The device of claim 15, wherein a single drawbar is used to connect a pair of adjacent railroad cars, and the confronting brackets of each rigid subframe straddle the drawbar in axially spaced relation from the middle of the drawbar.

17. The device of claim 15, wherein an interlocking knuckle-type coupler with an elongated shank is used to connect a pair of adjacent railroad cars, and the confronting brackets of each rigid subframe straddle the shank of an adjacent coupler.

18. The device of claim 17, wherein each of the couplers includes a coupler head attached to the distal end of the shank, and the confronting brackets straddle the shank of each coupler adjacent the coupler head thereof.

19. A railroad freight car which, when horizontally disposed, comprises:

a) a rigid, under carriage supporting the framework of the car which has a pair of opposing ends;

b) a pair of rigid subframes adjacent the opposing ends of the car;

c) means mounting the rigid subframes below the under carriage for rotating in horizontal planes;

d) a number of low friction bearing pads carried by each of the rigid subframes in close proximity to the undercarriage for sliding engagement with adjacent flat surfaces of the under carriage of the car to stabilize the car in supported relation on the rigid subframes;

e) a single axle truck secured to each of the rigid subframes for rotation therewith, the single axle trucks extending from the rigid subframes and having wheels for rolling engagement with rails of a trackway disposed below the car;

f) car coupling means designed to couple each of the opposing ends of the car to adjacent railroad cars; and g) means carried by each of the rigid subframes for engaging an adjacent car coupling means and responsive to at least lateral movement of the car coupling means as the car moves along a curve in the trackway, to correspondingly rotate the rigid subframes to actively steer the attached single axle trucks through the curve, the means for rotating the rigid subframes including i) a car coupling means with an elongated shank, and ii) at least one steering arm secured to each of the rigid subframe and extending therefrom in a direction towards an adjacent elongated shank for engagement therewith and responsive to movement thereof, whereby the attached rigid subframe is rotated to actively steer the attached single axle truck, the at least one steering arm including a pair of steering arms which extend in parallel relation toward an adjacent elongated shank for straddling the shank therebetween.

20. The railroad car of claim 19, wherein each pair of parallel steering arms have a pair of laterally spaced free distal ends with upstanding brackets which confront each other in spaced relation for straddling the elongated shank.

* * * * *